United States Patent [19]

Ogi et al.

[11] Patent Number: 4,990,438

[45] Date of Patent: Feb. 5, 1991

[54] DIRECT POSITIVE LIGHT-SENSITIVE SILVER HALIDE PHOTOGRAPHIC MATERIAL

[75] Inventors: Keiji Ogi; Eiichi Sakamoto; Tomomi Yoshizawa, all of Tokyo, Japan

[73] Assignee: Konica Corporation, Tokyo, Japan

[21] Appl. No.: 419,141

[22] Filed: Oct. 10, 1989

[30] Foreign Application Priority Data

Oct. 13, 1988 [JP] Japan ..... 63-260339

[51] Int. Cl.[5] ..... G03C 1/02

[52] U.S. Cl. ..... 430/567; 430/598; 430/611; 430/613; 430/614; 430/621; 430/622; 430/623; 430/626

[58] Field of Search ..... 430/598, 611, 613, 614, 430/621, 622, 623, 626, 567

[56] References Cited

U.S. PATENT DOCUMENTS

| | | | |
|---|---|---|---|
| 4,495,274 | 1/1985 | Yoshida | 430/611 |
| 4,607,004 | 8/1986 | Ikenoue et al. | 430/622 |
| 4,837,143 | 6/1989 | Komorita et al. | 430/613 |
| 4,868,102 | 9/1989 | Ogi et al. | 430/598 |
| 4,871,658 | 10/1989 | Sakamoto et al. | 430/614 |

*Primary Examiner*—Charles L. Bowers, Jr.
*Assistant Examiner*—Thomas R. Neville
*Attorney, Agent, or Firm*—Frishauf, Holtz, Goodman & Woodward

[57] ABSTRACT

Disclosed is a direct positive light-sensitive photographic material having at least one silver halide emulsion layer containing inner latent image type silver halide grains not previously fogged, which gives a direct positive image after image exposure by surface development after application of fogging treatment or while applying fogging treatment, wherein the inner latent image type silver halide grains comprise substantially silver chloride, and the silver halide emulsion layer or a hydrophilic colloid layer adjacent thereto contains at least one active halide type or active vinyl type gelatin hardener, and at least one compound represented by the formula (I) or (II) described in the specification. This direct positive light-sensitive silver halide photographic material is particularly excellent in stability with lapse of time.

26 Claims, No Drawings

DIRECT POSITIVE LIGHT-SENSITIVE SILVER HALIDE PHOTOGRAPHIC MATERIAL

BACKGROUND OF THE INVENTION

This invention relates to a direct positive light-sensitive silver halide photographic material, particularly to a direct positive light-sensitive silver halide photographic material excellent in stability with lapse of time.

The methods to be used for preparing positive images by use of the direct positive type light-sensitive material known in the art can be classified mainly into the two types.

One type is to use a silver halide emulsion previously fogged and obtain a positive image after developing by destroying the fogged nucleus (latent image) at the exposed portion by utilizing solarization or Herschel effect, etc.

The other type is to use the inner latent image type silver halide emulsion not previously fogged and obtain a positive image by effecting surface development after applying the fogging treatment subsequent to image exposure after applying the fogging treatment or while applying the fogging treatment.

Here, the fogging treatment may be performed by giving the whole surface exposure or chemically by use of a foggant, or alternatively by use of a strong developer or heat treatment, etc., but ordinarily the method by use of light or a foggant is employed. The inner latent image type silver halide photographic emulsion refers to a silver halide photographic emulsion, having light-sensitive nuclei primarily internally of the silver halide grains which forms latent images internally of the grains by exposure.

The method of the latter type is generally higher in sensitivity as compared with the former type and suitable for application in which high sensitivity is required, and particularly the present invention concerns the latter type.

In this field of the art, there have been heretofore known various techniques. For example, those as described in U.S. Pat. Nos. 2,592,250, 2,466,957, 2,497,875, 2,588,982, 3,761,266, 3,761,276, 3,796,577 and U.K. Patent No. 1,151,363 are the main ones.

By use of these known methods, light-sensitive materials of relatively higher sensitivity can be prepared as the direct positive type.

Also, as to the formation mechanism of positive image, it may be considered as follows, as described in Photographic Science and Engineering, vol. 20, p. 158, 1976. That is, the photoelectrons formed within the silver halide grains by image exposure are selectively captured internally of the grains to form an inner latent image. Since the inner latent image acts as effective capturing centers for the electrons existing in the electroconduction band, the electrons to be injected in the subsequent fogging development process will be captured internally to intensify the latent image. In this case, since the latent images are all within the grains and therefore will not be developed. On the other hand, in the grains not subjected to image exposure, at least a part of the electrons injected are captured on the grain surface, and said grains are developed through surface development.

By use of the above known techniques, although it is possible to prepare a light-sensitive photographic material forming a positive image, further improvement of the photographic performances is desirable for applying these light-sensitive photographic materials in various fields of photography.

For example, in recent years, by utilizing a copying device with a printed manuscript or a photography as the original, it has become possible to copy an image directly on the above direct positive type color paper or color film. For copying devices of such photographic system to be propagated widely in various uses, it is strongly desirable to shorten further the processing time of the light-sensitive photographic material.

In the prior art, for shortening the processing time of light-sensitive color photographic material, various methods have been employed. As is well known in the art, among silver halide crystals, silver chloride crystals are higher in ion crystallinity and also relatively higher in water-solubility than other silver bromide or silver iodide, and they have the characteristic of rapid developing, bleaching and fixing reactions. Accordingly, by use of silver halide with high silver chloride content, all the processings of developing, bleaching and fixing can be performed rapidly to be advantageous for shortening of the processing time.

The inner latent image type silver halide grains containing silver chloride are also well known, and one of the core/shell structure is disclosed in Japanese Unexamined Patent Publication No. 32820/1972 and also silver halide crystal grains of the structure having a layer with higher content of silver chloride laminated in Japanese Unexamined Patent Publications Nos. 8524/1975 and 38525/1975.

On the other hand, although the maximum density of the direct positive image obtained by use of the inner latent image type silver halide emulsion comprising primarily silver chloride is high, the minimum density (fog) cannot become sufficiently small, and also is susceptible to change depending on the storage state after preparation. Particularly, when stored under high temperature and high humidity, the minimum density becomes remarkably higher with lapse of time, resulting in impairment of the quality of white ground of the image to pose one problem in practically applying this kind of emulsion.

In the prior art, various antifoggants or development inhibitors have been known for the purpose of improving such undesirable phenomenon. For example, benzotriazoles described in U.S. Pat. No. 2,497,917, heterocyclic thione compounds described in Japanese Patent Publication No. 12709/1970, tetrazole type compounds described in U.S. Pat. No. 3,352,672 have been used as the inhibitors. However, even when these compounds may be used, inhibition against fog and negative image generated with lapse of time is insufficient to give no sufficient white ground, and also use of a large amount of inhibitor as suggested in the above patents is not desirable because development is remarkably inhibited to lower the image density.

Further, in the recent field of photography, it has been well known to shorten and expedite the processing time by performing development and the post-processing steps (desilverization, fixing, water washing, etc.) subsequent thereto at high temperature. When development is performed at a high temperature, for example, a temperature of 30° C. or higher, the fog generated by storage with lapse of time is further amplified.

SUMMARY OF THE INVENTION

Accordingly, an object of the present invention is to provide a direct positive light-sensitive silver halide photographic material which has sufficiently great maximum density, sufficiently small minimum density and yet can maintain stable photographic characteristics even when stored and left to stand under high temperature and high humidity.

The above object of the present invention has been accomplished by a direct positive light-sensitive photographic material having at least one silver halide emulsion layer containing inner latent image type silver halide grains not previously fogged, which gives directly a positive image after image exposure by surface development after application of fogging treatment or while applying fogging treatment, wherein said inner latent image type silver halide grains comprise substantially silver chloride, and the above silver halide emulsion layer or a hydrophilic colloid layer adjacent thereto contains at least one active halide type or active vinyl type gelatin hardener, and at least one of the compounds represented by the formula (I) or (II) shown below:

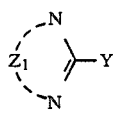

Formula (I)

wherein $Z_1$ represents a group of atoms necessary for forming a 5- or 6-membered heterocycle containing at least one of carbon atom or nitrogen atom, which heterocycle may be fused with carbon ring; Y represents an aliphatic group or an aromatic group,

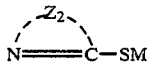

Formula (II)

wherein $Z_2$ represents a group of atoms necessary for forming oxadiazole, thiadiazole, triazole, tetrazole, triazine, benzoimidazole, naphthoimidazole, benzoxazole or naphthoxazole ring; M represents hydrogen atom, an alkali metal atom, ammonium group or a precursor group.

DETAILED DESCRIPTION OF THE INVENTION

The silver halide grains of the present invention comprise substantially silver chloride, containing at least 80 mol %, preferably at least 90 mol % of silver chloride, and may further contain silver bromide, silver iodide or a mixture thereof.

Also, the silver halide grains of the present invention should preferably have a core/shell structure comprising a core and at least one layer of shell covering over said core. In this case, the shell should be preferably one covering 50% or more of the surface area of the core, further particularly preferably one covering the core completely.

The silver halide shell covering the core can be prepared according to the double jet method in which an aqueous silver salt solution and an aqueous silver salt are added and mixed simultaneously, or the multiple jet method in which an aqueous silver salt solution and two or more kinds of aqueous halogen solutions are added and mixed independently each other.

As the double jet method, there can be used the so-called controlled double jet method in which mixing is effected while controlling pAg or pH of the mixture.

Also, the shell can be formed by Ostwald aging by mixing fine particulate silver halide, for example, fine particulate emulsion of silver chloride with the core emulsion.

The pAg value during shell preparation, which may differ depending on the silver halide composition, may be, for example, 8.5 or lower, preferably 8.0 or lower. The pH value can be controlled suitably according to the acidic method, the neutral method or the ammonia method.

The shape of the silver halide grains forming the core may be any one, such as hexahedral, octahedral, dodecahedral, tetradecahedral or in the form of a mixture of these, and may be also spherical, flat plate, irregular grains. The average grains size and the grain size distribution of the silver halide grains constituting the core can be varied widely depending on the photographic performance sought after, but the grain size distribution should be preferably narrower. More specifically, in the present invention, the silver halide grains constituting the core should preferably be substantially mono-dispersed.

Here, the mono-dispersed silver halide grains of the core mean that the weight of the silver halide grains contained within the grain size range of ±20% with the average grain size $\bar{r}$ as the center in the silver halide grains constituting the core is 60% or more of the total silver halide weight, preferably 70% or more, particularly preferably 80% or more.

In the present specification, the average grain size $\bar{r}$ means the grain size $r_i$ at which the product $n_i \times r_i^3$ of the frequency $n_i$ of the grains having the grain size $r_i$ becomes the maximum (effective numerical 3 cipher the minimum cipher being rounded).

The grain size as herein mentioned refers to its diameter in the case of spherical silver halide grain, while the diameter of the circular image calculated of the same area from its projected image in the case of grains with shapes other than sphere.

The gain size can be obtained by, for example, projecting said grain with enlargement to 10,000-fold to 50,000-fold by an electron microscope and measuring the grain diameter or the area during projection on its print (the number of grains measured is made indiscriminately 1,000).

In the present specification, the wording average grain size is used in the meaning as defined above.

For preparation of the above mono-dispersed core emulsion, for example, the double jet method as described in Japanese Patent Publication No. 36890/1973, Japanese Unexamined Patent Publications Nos. 48520/1979 and 65521/1979 can be used. Otherwise, the premix method as disclosed in Japanese Unexamined Patent Publication No. 158220/1979 can be also used.

The core of the silver halide grain in the present invention may be one which is chemically sensitized, or doped with metal ions, or alternatively applied with the both, or not applied with the both at all.

Concerning chemical sensitization, a large number of methods have been known. That is, there may be included sensitization methods such as sulfur sensitization, gold sensitization, reducing sensitization, noble metal sensitization and combinations of these sensitization methods. As the sulfur sensitizer, thiosulfates, thioureas, thiazoles, rhodanines, and other compounds can be used. Such methods are described in, for example, U.S. Pat. Nos. 1,574,944, 1,623,499, 2,410,689 and 3,656,955, etc.

The core of the silver halide grain to be used in the present invention can be also sensitized with a water-soluble gold salt as described in U.S. Pat. Nos. 2,399,083, 2,597,856 and 2,642,361, and also can be sensitized with a reducing sensitizer. For such methods, reference can be made to the descriptions in, for example, U.S. Pat. Nos. 2,487,850, 2,518,698 and 2,983,610, etc.

Further, noble metal sensitization is also possible by use of a noble metal compound such as of platinum, iridium, palladium, etc. For such methods, reference can be made to the descriptions in, for example, U.S. Pat. No. 2,448,060 and U.K. Patent No. 618,061.

The core of the silver halide grain in the present invention can be doped with metal ions. For doping of the core with metal ions, for example, in either process of forming the core grains, a water-soluble salt of the metal ion can be added. Preferable specific examples of the metal ion may include metal ions such as iridium, lead, antimony, bismath, gold, osmium, rhodium, etc. These metal ions may be used preferably in a concentration of $1\times10^{-8}$ to $1\times10^{-4}$ mol per mol of silver.

The core of the silver halide grain in the present invention may be also one not applied with chemical sensitization treatment or doping of metal ions as described above. In this case, in the process of coating the core grains with shell, photosensitive centers are considered to be formed at the interface between the core and the shell by way of crystal strain and others, and concerning this, reference can be made to the descriptions in U.S. Pat. Nos. 3,935,014 and 3,957,488.

The shell of the silver halide grain in the present invention can cover completely the silver halide grain surface, or alternatively selectively a part of the surface.

The shell in the silver halide grain in the present invention may be a single layer with a single silver halide composition or a multi-layer shell comprising two or more layers.

Said multi-layer shell comprises at least the outermost layer and a layer adjacent thereto, but it is also possible to take a structure in which layer having different silver halide compositions from each other are laminated.

Also, the shell layers of said multi-layer may take a structure in which the silver halide composition is varied successively in the diameter direction of the silver halide grain.

The above shell in the present invention comprises substantially silver chloride, at least 90 mol %, preferably 95 mol % or more of silver chloride, and may further contain silver bromide, silver iodide or a mixture thereof. In this case, the compositions may be the same as or different from that of the silver halide composition of the above core.

The core/shell type silver halide grains in the present invention may also have the grain surface subjected to chemical sensitization, if necessary. In the case of chemically sensitizing the grain surface, conventional sulfur sensitization, reducing sensitization, noble metal sensitization, a combination of these can be practiced. Useful surface chemical sensitizations are described in U.S. Pat. No. 3,761,276.

Also, in place of chemical sensitization of the grain surface, fogging development can be promoted by use of a surface image stabilizer (e.g. dialkanolamine, developing agent, tetraazaindene, sulfite, bromide, etc.) as described in Japanese Unexamined Patent Publication No. 32820/1972.

The ratios of the silver halide in the core portion and the shell portion in the present invention can be determined as desired, but the ratio of the shell portion should be preferably made 10% to 99% based on the total silver halide of the silver halide grains.

The composition ratio of the silver halide grains in the present invention comprises 80 mol % or more, preferably 90 mol % or more of silver chloride, of the whole grains.

By the grain surface not previously fogged is meant that the density obtained when a test strip having the emulsion to be used in the present invention is coated on a transparent support to 35 mg Ag/cm$^2$ is developed without exposure with the following surface developer A does not exceed 0.6, preferably 0.4.

| Surface developer A | |
|---|---|
| Metol | 2.5 g |
| l-Ascorbic acid | 10 g |
| Sodium metaborate (tetrahydrate) | 35 g |
| Potassium bromide | 1 g |
| Water added to one liter | |

Also, the silver halide emulsion according to the present invention gives sufficient density when the test strip prepared as described above is exposed and developed with the internal developer having the following recipe.

| Internal developer B | |
|---|---|
| Metol | 2 g |
| Sodium sulfite (anhydrous) | 90 g |
| Hydroquinone | 8 g |
| Sodium carbonate (monohydrate) | 52.5 g |
| Potassium bromide | 5 g |
| Potassium iodide | 0.5 g |
| Water added to one liter | |

To describe in more detail, when a part of the above test strip is exposed to a light intensity scale over a predetermined time up to about one second and developed with the internal developer B at 20° C. for 10 minutes, it exhibits the maximum density which is at least 5-fold, preferably at least 10-fold of that obtained when another part of said test strip is developed with the surface developer A at 20° C. for 10 minutes.

Of the gelatin hardeners to be used in the present invention, the active halogen type refers to those containing halogen atoms capable of reacting with gelatin in the molecule, including, for example, the compounds as described in U.S. Pat. No. 2,732,303, U.K. Patent No. 932,998, French Patent No. 1,296,928 and Japanese Patent Publication No. 6151/1972.

On the other hand, the active vinyl type hardener contains a vinyl group capable of reacting with gelatin in the molecule, including, for example, the compounds as described in Japanese Patent Publication No. 13563/1974, Japanese Unexamined Patent Publications Nos. 73122/1974, 4463/1976, 21059/1977, 41221/1978, 57257/1978 and U.S. Pat. No. 3,490,911.

In the following, specific examples of the gelatin hardener to be used in the present invention are shown, which are not limitative of the present invention.

(Active halogen type hardener)

H-1

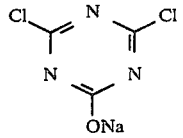

H-2

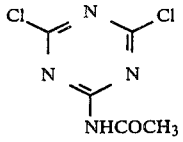

H-3

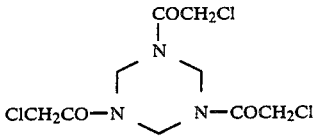

H-4 $ClCH_2COOCH_2CH_2OCOCH_2Cl$

H-5

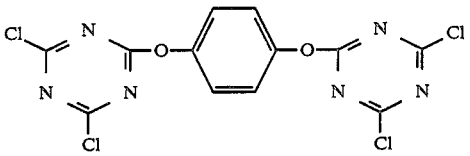

(Active vinyl type hardener)

H-6 $CH_2{=}CHSO_2CH_2CH_2SO_2CH{=}CH_2$

H-7 $CH_2{=}CHSO_2CH_2CH(OH)CH_2SO_2CH{=}CH_2$

H-8 $CH_2{=}CHSO_2CH_2CH_2CONHCH_2$
$CH_2{=}CHSO_2CH_2CH_2CONHCH_2$

H-9 $CH_2{=}CHSO_2CH_2OCH_2SO_2CH{=}CH_2$

H-10

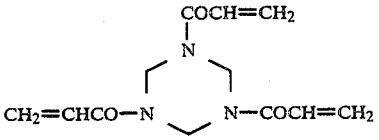

These compounds can be synthesized according to the methods, in addition to those in the above patents, as described in Japanese Patent Publications Nos. 33880/1972 and 2541/1979, U.K. Patent No. 932,978, etc. for the active halogen type, and Japanese Patent Publications Nos. 24259/1972 and 35807/1975, Japanese Unexamined Patent Publications Nos. 24435/1974, 18944/1984 and French Patent No. 1,491,807 for the active vinyl type.

The amount of these hardeners added, which may differ depending on the kind and physical characteristics of the gelatin employed, the photographic characteristics of the light-sensitive photographic material, processing conditions, etc., may be preferably within the range of 0.05 to 20% by weight, more preferably 0.1 to 10% by weight, based on the gelatin in the coating solution. In this case, if necessary, it is also possible to use other hardeners in combination within the range which does not impair the effect of the present invention.

The timing of addition of the hardener may be at any step of preparing the coating solution for forming the gelatin film.

Next, the compounds represented by the above formula (I) are described in detail.

Formula (I)

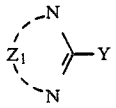

In the formula (I), $Z_1$ represents a group of atoms necessary for forming a 5- or 6-membered heterocycle containing at least one of carbon atom or nitrogen atom, and said heterocycle may be also fused with carbon ring. Examples of these heterocycles may include indazole, imidazole, pyrazole, triazole, tetrazole, benzoimidazole, benzotriazole, naphthoimidazole, etc.

These heterocycles may also have substituents, and the substituents are not particularly limited, but may include halogen atoms as wells as respective groups such as hydroxyl, amino, nitro, carboxyl (including salts), sulfo (including salts), alkyl, aryl, alkoxy, aryloxy, alkylthio, acylamino, sulfonamide, carbamoyl, sulfamoyl, etc.

Preferable as the aliphatic group represented by Y are alkyl groups having 1 to 10, more preferably 1 to 8 carbon atoms (e.g. methyl, ethyl, propyl, butyl, pentyl and octyl groups), cycloalkyl groups having 3 to 10 carbon atoms (e.g. cyclopentyl and cyclohexyl groups), alkenyl groups having 1 to 10, preferably 3 to 8 carbon atoms (e.g. allyl, 2-butenyl and 2-hexenyl groups), and as the aromatic group, phenyl group and naphthyl group.

These aliphatic groups and aromatic groups may also have substituents, and examples of the substituents may include the same as described for the above heterocycles.

Among the compounds represented by the formula (I), particularly preferred are the compounds represented by the following formula (I-A).

Formula (I-A)

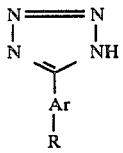

In the formula, Ar represents an aryl group (e.g. phenyl and naphthyl group), and R represents a substituent possessed by the Ar group.

R is not particularly limited, but may include, for example, hydrogen atom, cyano group, nitro group, alkyl groups having 1 to 10, preferably 1 to 8 carbon atoms (e.g. methyl, ethyl, propyl, butyl, sec-butyl, pentyl, t-pentyl, neopentyl, hexyl and octyl groups), alkenyl group having 2 to 10, preferably 3 to 8 carbon atoms (e.g allyl, 2-butenyl and 2-hexenyl groups), cycloalkyl groups having 3 to 10 carbon atoms (e.g. cyclopentyl and cyclohexyl groups), alkoxy groups having 1 to 10, preferably 1 to 8 carbon atoms (e.g. methoxy, ethoxy, butoxy and hexyloxy groups), aryloxy groups (e.g. phenoxy group), amino groups (e.g. amino, ethylamino, dimethylamino and anilino groups), hydroxyl group, carbamoyl group (e.g carbamoyl, methylcarbamoyl and phenylcarbamoyl groups), sulfamoyl group (e.g. sulfamoyl, dimethylsulfamoyl and phenylsulfamoyl groups), carbonamide group (e.g. acetamide and benzamide groups), ureido groups (e.g. ureido, methylureido and phenylureido groups), acyl group (e.g. acetyl and benzoyl groups), acyloxy group (e.g. acetyloxy and benzoyloxy groups), carboxyl group and salts thereof, sulfo group and salts thereof, alkoxycarbonyl group, aryloxycarbonyl group, aralkyl group (e.g. benzyl and phenethyl group), etc.

The above alkyl group may be further substituted, and for example, halogen atoms (e.g. chlorine and bromine) and respective groups of hydroxyl, carboxyl, phenyl, alkylthio, arylthio, acyl, alkoxycarbonyl, etc. may be included.

In the following, specific examples represented by the formula (I) (abbreviated as the compound I of the present invention) are shown.

I-1

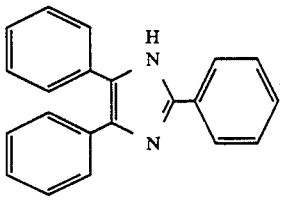

I-2

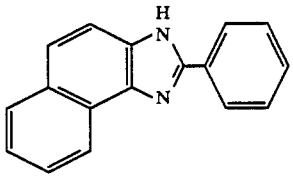

I-3

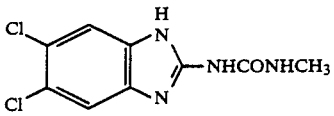

I-4

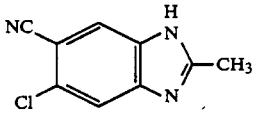

I-5

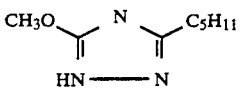

I-6

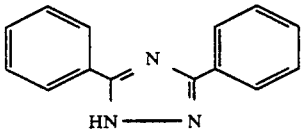

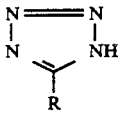

| No. | R |
|---|---|
| I-7 | $-C_2H_5$ |

-continued

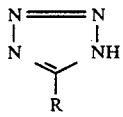

| No. | R |
|---|---|
| I-8 | 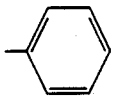 |
| I-9 | 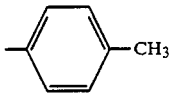 |
| I-10 | 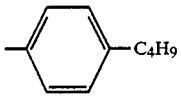 |
| I-11 | 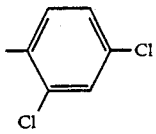 |
| I-12 | 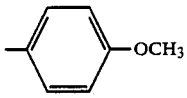 |
| I-13 | 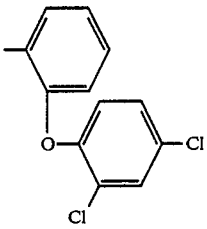 |
| I-14 | 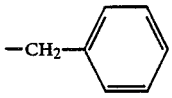 |
| I-15 | 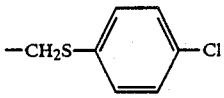 |
| I-16 | $-OC_2H_5$ |
| I-17 | 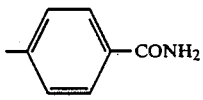 |
| I-18 | 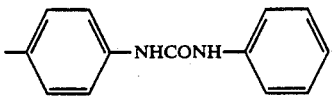 |

-continued

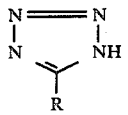

| No. | R |
|---|---|
| I-19 | 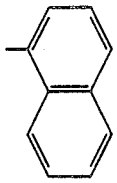 |
| I-20 | 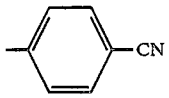 |
| I-21 | 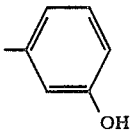 |
| I-22 | 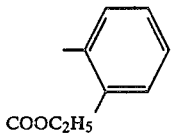 |
| I-23 | 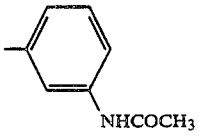 |
| I-24 | 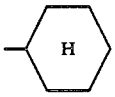 |
| I-25 | 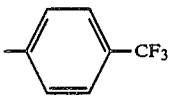 |
| I-26 | 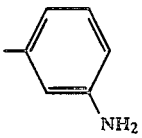 |
| I-27 | 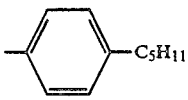 |
| I-28 | $-C_{13}H_{27}$ |
| I-29 | $-C_8H_{17}$ |
| I-30 | 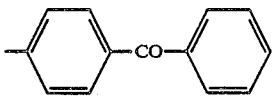 |

-continued

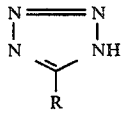

| No. | R |
|---|---|
| I-31 | 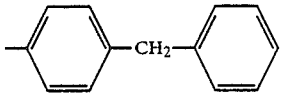 |

Next, the compounds represented by the formula (II) are to be described.

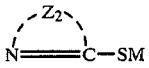

Formula (II)

In the formula (II), the oxadiazole, thiadiazole, triazole, tetrazole, triazine, benzoimidazole, naphthoimidazole, benzoxazole or naphthoxazole ring may also have substituents.

The substituent is not particularly limited, but may include alkyl groups which may be substituted (e.g. methyl, ethyl, trifluoromethyl, i-propyl, butyl, t-butyl, neopentyl, hexyl, octyl, benzyl, etc.), alkenyl groups (e.g. allyl, 2-butenyl, 3-hexenyl, etc.), cycloalkyls (e.g. cyclopentyl, cyclohexyl, etc.), aryl groups which may be also substituted (e.g. phenyl, naphthyl, 4-methoxyphenyl, 4-carboxyphenyl, 4-sulfonatophenyl, 3-acetylaminophenyl, 4-methylsulfamoylphenyl, 3-methylureidophenyl, 4-ethoxycarbonylphenyl, etc.), alkoxy groups (e.g. methoxy, ethoxy, butoxy, etc.), alkylthio groups (e.g. methylthio, octylthio, etc.), amino groups (e.g. amino, dimethylamino, anilino, etc.), carbamoyl group (e.g. carbamoyl, methylcarbamoyl, phenylcarbamoyl, etc.), sulfamoyl groups (e.g. sulfamoyl, ethylsulfamoyl, phenylsulfamoyl, etc.), carbonamide groups (e.g. acetamide, benzamide, etc.), sulfonamide groups (e.g. methanesulfonamide, benzenesulfonamide, etc.), ureido groups (e.g. ureido, methylureido, diethylureido, phenylureido, etc.), acyl groups (e.g. acetyl, benzoyl, etc.), acyloxy groups (e.g. acetyloxy, benzoyloxy, etc.), carboxyl group and salts thereof, sulfo group and salts thereof, alkoxycarbonyl groups (e.g. ethoxycarbonyl, etc.), aryloxycarbonyl groups (e.g. phenoxycarbonyl, etc.), etc., and further cyano group, nitro group, hydroxyl group and others.

Of the formula (II), the compounds particularly preferably used in the present invention are those represented by the following formula (II-A).

Formula (II-A)

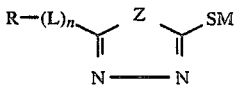

In the formula, Z represents oxygen atom, sulfur atoms or

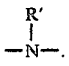

L represents a divalent linking group, and R represents an alkyl group, an alkenyl group or an aryl group. M represents hydrogen atom, an alkali metal atom, ammonium group or a precursor. n represents 0 or 1.

The precursor refers to a group which can become H (hydrogen) under alkaline conditions, representing, for example, acetyl group, cyanoethyl group, methanesulfonylethyl group, etc.

R' represents hydrogen atom, an alkyl group, an alkenyl group, an aryl group or an acyl group.

Of the above R, alkyl groups and alkenyl groups include unsubstituted and substituted groups, and further alicyclic groups. Examples of the substituents of substituted alkyl groups may include halogen atoms, nitro, cyano, hydroxyl, alkoxy, aryl, acylamino, alkoxycarbonylamino, ureido, amino, heterocycles, acyl, sulfamoyl, sulfonamide, thioureido, carbamoyl, alkylthio, arylthio, heterocyclicthio groups, etc., and further carboxyl group and salts thereof, sulfo group and salts thereof, etc.

The respective groups of the above ureido, thioureido, sulfamoyl, carbamoyl, amino include unsubstituted groups and N-alkyl substituted groups and N-aryl substituted groups. Examples of the aryl groups are phenyl group or substituted phenyl groups, and the substituents thereof may include alkyl groups and the substituents on the alkyl group as mentioned above.

Specific examples of the divalent linking group represented by L may include:

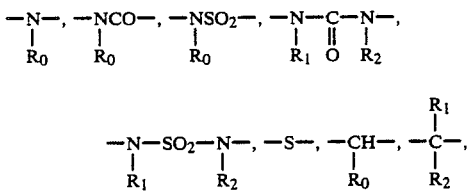

etc. and combinations of these.

Here, each of $R_0$, $R_1$ and $R_2$ represents hydrogen atom, an alkyl group or an aralkyl group.

In the following, specific examples of the compounds represented by the formula (II) (abbreviated as the compounds II of the present invention) are shown.

II-1

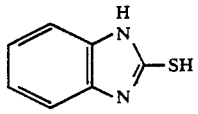

II-2

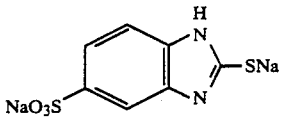

II-3

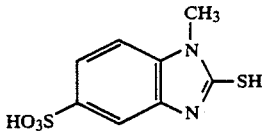

-continued

II-4

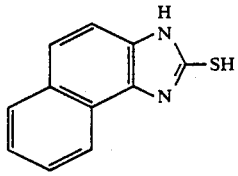

II-5

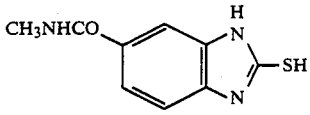

II-6

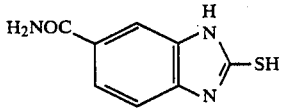

II-7

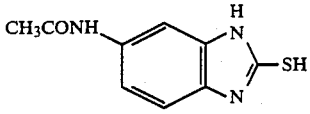

II-8

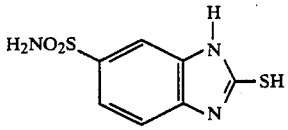

II-9

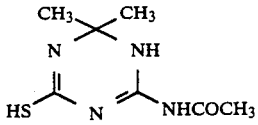

II-10

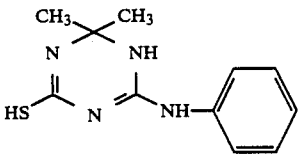

II-11

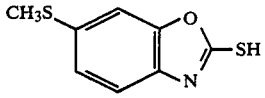

II-12

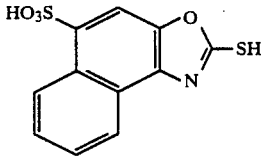

II-13

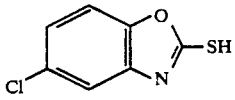

II-14

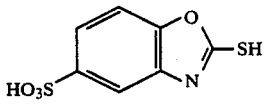

II-15

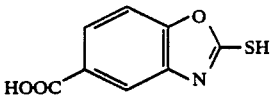

-continued
II-16
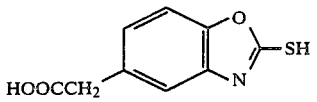
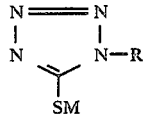
| No. | R | M |
|---|---|---|
| II-17 | $-C_6H_{13}$ | H |
| II-18 | 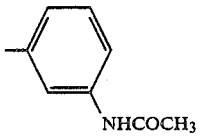  | H |
| II-19 | 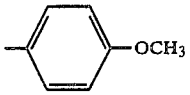  | H |
| II-20 | 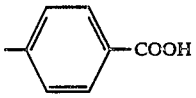  | H |
| II-21 | 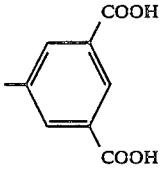  | H |
| II-22 | 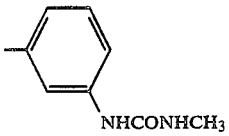  | H |
| II-23 | 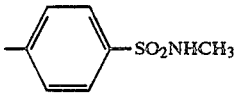  | H |
| II-24 | 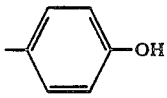  | H |
| II-25 | 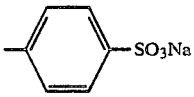  | Na |
-continued
| | | |
|---|---|---|
| II-26 | 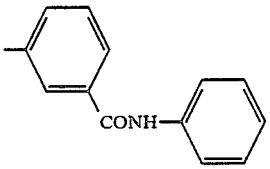  | H |
| II-27 | 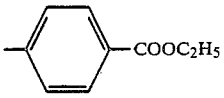  | H |
| II-28 | 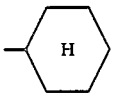  | H |
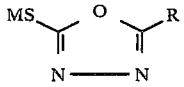
| | | |
|---|---|---|
| II-29 | $-C_2H_5$ | H |
| II-30 | 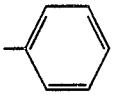 | H |
| II-31 | $-C_4H_9(t)$ | $NH_4$ |
| II-32 | $-NHSO_2CH_3$ | H |
| II-33 | 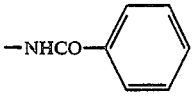  | H |
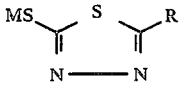
| | | |
|---|---|---|
| II-34 | $-NHCOCH_3$ | H |
| II-35 | $-SCH_2COOH$ | H |
| II-36 | $-S(CH_2)_3SO_3Na$ | Na |
| II-37 | $-SCH_2CH_2OH$ | H |
| II-38 | $-S(CH_2)_3N(CH_3)_2.HCl$ | H |
| II-39 | $-CH_3$ | H |
| II-40 | $-CH_2OCH_3$ | H |
| II-41 | $-NHCONHCH_3$ | H |
| II-42 | $-NHSO_2CH_3$ | Na |
| II-43 | $-CH_2CH_2N(CH_3)_2$ | H |
| II-44 | $-SCH_2CH_2CN$ | H |
| II-45 | $-SCOCH_3$ | $-COCH_3$ |
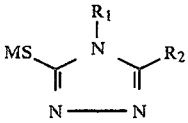
| No. | $R_1$ | $R_2$ | M |
|---|---|---|---|
| II-46 | $-CH_3$ | $-NHCOOC_2H_5$ | H |
| II-47 | 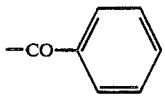  | 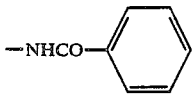  | H |
| II-48 | $-CH_3$ | $-NHCOCH_3$ | H |

-continued

| | | | |
|---|---|---|---|
| II-49 | 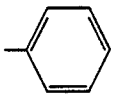 | $-NHSO_2CH_3$ | H |
| II-50 | $-CH_2CH{=}CH_2$ | $-NHCOCH_3$ | H |
| II-51 | H | 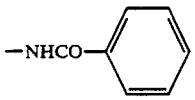 | H |

The compounds of the formula (I) can be synthesized easily according to the method as described in Journal of the American Chemical Society (J. Am, Chem. Soc.), 80, 3908 (1959) or Journal of Organic Chemistry (J. Org. Chem.), 24, 1650 (1959), etc.

The compounds of the formula (II) can be synthesized easily according to the methods as describe in J. Org. Chem. (supra) 39, 2469 (1969), J. Chem. Soc. 17 23 (1951), Annerlein der Chemistry (Ann. Chem.) 44, 3 (1954), Chemish Bericht (Chem. Ber.) 20, 231 (1887), the same journal 82,121 (1948), the same journal 89, 1012 (1956), U.S. Pat. Nos. 2,403,927, 2,743,181, 2,824,001, 3,017,270, 3,266,897, 3,295,976, Japanese Unexamined Patent Publications Nos. 102639/1976, 59463/1980, 79436/1980, 95728/1983, U.K. Patents Nos. 940,169 and 1,275,701.

These compounds of the present invention may be added into the constituent element of the light-sensitive silver halide photographic material as a solution dissolved in water or an organic solvent having affinity for water such as methanol, acetone, etc., or dissolved in a weakly alkaline water.

The content of the compound of the present invention may be enough to inhibit fogging or negative image at the exposed portion, when the inner latent image type light-sensitive silver halide photographic material is given the whole surface exposure or developed in the presence of a foggant.

The amount added may be suitably varied depending on the kind of the compound used or the layer into which it is added, but generally when added into the silver halide emulsion layer, may be within the range of $10^{-8}$ mol to $10^{-2}$ mol, more preferably $10^{-6}$ mol to $10^{-2}$ mol, per mol of silver halide.

The compound of the present invention may be added into any of the constituent layers conventionally provided in the light-sensitive material, typically silver halide emulsion layers, as well as protective layer, intermediate layer, filter layer, halation preventive layer, subbing layer, etc., but particularly preferably the silver halide emulsion layers.

The timing of addition in the case of a silver halide emulsion layer may be at an appropriate timing after completion of aging of said emulsion before coating, while in the case of other layers at an appropriate timing from during preparation of the coating solution to before coating.

The silver halide emulsion according to the present invention can be optically sensitized with a sensitizing dye. The combination of sensitizing dyes to be used for ultra-color sensitization of the inner latent image type silver halide emulsion, the negative type silver halide emulsion, etc. is also useful for the silver halide emulsion of the present invention. Concerning sensitizing dyes, reference can be made to Research Disclosure No. 15162 and No. 17643.

The light-sensitive photographic material of the present invention can be subjected to image exposure (photographing) in conventional manner and then surface development, whereby a direct positive image can be easily obtained. More specifically, the main step for preparing the direct positive image comprises subjecting the light-sensitive photographic material having the inner latent image type silver halide emulsion layer not previously fogged of the present invention after image exposure to surface development after applying the processing of forming fog nuclei by chemical action or optical action after image exposure, namely the fogging processing and/or while applying the fogging processing. Here, fogging processing can be performed by giving whole surface exposure or by use of a compound forming fogging nucleus, namely a foggant.

In the present invention, the whole exposure is performed by dipping or wetting the light-sensitive material after image exposure in a developer or another aqueous solution, followed by uniform exposure on the whole surface. As the light source to be used here, any light within the light-sensitive wavelength region of the light-sensitive photographic material may be used, and a high luminance light like flash light can be irradiated for a short time, or alternatively a weak light may be also irradiated for a long time. Also, the time of the whole surface exposure can be varied over a wide range so that the best positive image can be obtained finally depending on the light-sensitive photographic material, the developing processing conditions, the kind of the light source employed, etc.

As the foggant to be used in the present invention, a wide variety of compounds can be used, and the foggant may be present during development processing, and may be incorporated in, for example, the constituent layers other than the support of the light-sensitive photographic material (among them, particularly preferably in the silver halide emulsion layer), or in a developer or a processing liquor prior to the development processing. Also, its amount can be varied over a wide range, and when added in the silver halide emulsion layer, preferable amount added may be 1 to 1,500 mg per mol of silver halide, preferably 10 to 1,000 mg. On the other hand, when added in processing liquor such as developer, preferable amount added may be 0.01 to 5 g/liter, particularly preferably 0.05 to 1 g/liter.

Examples of the foggant to be used in the present invention may include hydrazines as described in U.S. Pat. Nos. 2,563,785 and 2,588,982, hydrazide or hydrazone compounds as describe in U.S. Pat. No. 3,227,552; heterocyclic quaternary nitrogen salt compounds as described in U.S. Pat. Nos. 3,615,615, 3,718,479, 3,719,494, 3,734,738 and 3,759,901; and further compounds having adsorption groups onto the silver halide surface such as acylhydrazinophenyl thioureas as described in U.S. Pat. No. 4,030,925. Also, these foggants can be used in combination. For example, Research Disclosure (supra) No. 15162 discloses combined use of the nonadsorption type foggant and the adsorption type foggant, and this combination technique is also effective in the present invention.

As the foggant to be used in the present invention, either of the adsorption type and the nonadsorption type can be used, and they can be also used in combination.

Specific examples of useful foggants may include hydrazine compounds such as phenylhydrazine hydrochloride, 1-formyl-2-(4-methylphenyl)hydrazine, 1-acetyl-2-phenylhydrazine, 1-methylsulfonyl-2-(3-phenylsulfoamidophenyl)hydrazine and the like; N-substituted quaternary cycloammonium salts such as 3-(2-formylethyl)-2-methylbenzothiazolium bromide, 2-methyl-3-[3-(phenylhydrazino)propyl]benzothiazolium bromide and the like; 5-[1-ethylnaphtho(1,2-b)thiazolin-2-ylideneethylidene]-1-(2-phenylcarbazoyl)methyl-3-(4-sulfamoylphenyl)-2-thio-hydantoin, 5-(3-ethyl-2-benzothiazolinylidene)-3-[4-(2-formylhydrazino)phenyl]-rhodanine, 1-[4-(2-formyl-hydrazino)phenyl]-3-phenylthiourea, 1,3-bis[4-(2-formylhydrazino)phenyl]thiourea, etc.

The light-sensitive photographic material having s silver halide emulsion layer according to the present invention is subjected to image exposure, followed by the whole surface exposure or the surface development processing in the presence of a foggant to form a direct positive image. The surface development processing method means processing with a developer containing substantially no silver halide solvent.

As the developing agent which can be used in the surface developer to be used for development of the light-sensitive photographic material according to the present invention, there may be included conventional silver halide developing agents, for example, polyhydroxybenzenes such as hydroquinone, aminophenols, 3-pyrazolidone, ascorbic acid and its derivatives, reductones, phenylenediamines or mixtures thereof. Specifically, there may be included hydroquinone, aminophenol, N-methylaminophenol, 1-phenyl-3-pyrazolidone, 1-phenyl-4,4-dimethyl-3-pyrazolidone, 1-phenyl-4-methyl-4-hydroxymethyl-3-pyrazolidone, ascorbic acid, N,N-diethyl-p-phenylenediamine, diethylamino-o-toluidine, 4-amino-3-methyl-N-ethyl-N-(β-methanesulfonamidoethyl)aniline, 4-amino-3-methyl-N-ethyl-N-(β-hydroxyethyl)aniline and others. These developing agents can be also contained previously in the emulsion so as to act on silver halide during dipping in a high pH aqueous solution.

The developer to be used in the present invention can further contain a specific antifoggant and a development inhibitor, or those developer additives can be also incorporated as desired in the constituent layer of the light-sensitive photographic material.

In the silver halide emulsion according to the present invention, there can be also added various additives for photography such as humectants, film property improvers, coating aids, etc. depending on the purpose.

As other additives for photography, there can be also used gelatin plasticizers, surfactants, UV-ray absorbers, pH controllers, antioxidants, antistatic agents, thickeners, graininess improvers, dyes, mordants, fluorescent brighteners, developing speed controllers, matte agents, etc.

The silver halide emulsion prepared as described above is coated on the support through a subbing layer, a halation preventive layer, a filter layer, etc., if necessary, to give the inner latent image type light-sensitive silver halide photographic material.

It is useful to apply the light-sensitive photographic material according to the present invention for color, and in this case, it is preferable to incorporate dye image forming couplers of cyan, magenta and yellow. As the couplers, those conventionally used can be used, and reference can be made to the descriptions in RD-17643 (December, 1978) and 18717 (November, 1979) for its specific examples.

Also, for prevention of fading of the dye images with active rays of short wavelengths, it is useful to use a UV-ray absorber.

As the support of the light-sensitive material according to the present invention, there may be included, for example, polyethylene terephthalate film, polycarbonate film, polystyrene film, polypropylene film, cellulose acetate film, glass, baryta paper, polyethylene laminated paper, etc., which may be subjected to subbing, if necessary.

In the silver halide emulsion layer according to the present invention, as the protective colloid or binder, other than gelatin, a suitable gelatin derivative can be used. As the suitable gelatin derivative, for example, there can be included acylated gelatin, guanidylated gelatin, carbamylated gelatin, cyanoethanolated gelatin, esterified gelatin, etc.

Also, in the present invention, other hydrophilic binders can be contained depending on the purpose, including polyvinyl alcohol, polyvinyl pyrrolidone, hydrolyzed polyvinyl acetate, etc., which can be added in the lightsensitive photographic material constituent layers such as emulsion layer, intermediate layer, protective layer, filter layer, backing layer, etc., and further suitable plasticizers, lubricants, etc. can be incorporated in the above hydrophilic binder depending on the purpose.

Also, the constituent layer of the light-sensitive photographic material according to the present invention can be hardened with any desired suitable film hardener. As these film hardeners, chromium salts, zirconium salts, aldehyde type such as formaldehyde or mucohalogenic acid, halotriazine type, polyepoxy compound, ethyleneimine type, vinylsulfone type, acryloyl type film hardners may be included.

Also, the light-sensitive photographic material of the present invention can provide, in addition to having at least one light-sensitive emulsion layer containing the inner latent image type silver halide grains according to the present invention, a large number of various photographic constituent layers such as filter layer, intermediate layer, protective layer, subbing layer, backing layer, halation preventive layer, etc.

When the light-sensitive photographic material of the present invention is made for full color, at least one layer each of red-sensitive silver halide emulsion layer, green-sensitive silver halide emulsion layer and blue-sensitive silver halide emulsion layer are provided on the support. At this time, at least one layer of the light-sensitive silver halide emulsion layers may contain the inner latent image type silver halide grains according to the present invention, but it is preferable that all the light-sensitive silver halide emulsion layers should contain the inner latent image type silver halide grains according to the present invention. Also, the respective light-sensitive silver halide emulsion layers may be contained either in the same color-sensitive layer or separately in two or more layers with different sensitivities. In this case, at least one layer of the same color-sensitive layers with different sensitivities may contain the inner latent image type silver halide grains, but it is preferable that all the emulsion layers should contain the inner latent image type silver halide grains.

The light-sensitive photographic material according to the present invention is effectively applicable to various uses such as for black and white in general, for X-ray, for color, for pseudo-color, for printing, for IR, for micro, for silver dye bleaching, etc., and also applicable to the colloid transfer method, the silver salt diffusion transfer method, the color image transfer method, the color diffusion transfer method, etc. as described in U.S. Pat. Nos. 3,087,817, 3,185,567 and 2,983,606 of Rogers, U.S. Pat. No. 3,253,915 of Wayarts et al, U.S. Pat. No. 3,227,550 of Whitemore et al, U.S. Pat. No. 3,227,551 of Bar et al, U.S. Pat. No. 3,227,552 of Whitemore et al, U.S. Pat. Nos. 3,415,644, 3,425,645 and 3,415,646 of Land et al.

The present invention is described in more detail by referring to Examples, but the embodiments of the present invention are not limited thereto.

EXAMPLE 1

Equal moles of aqueous silver nitrate solution and aqueous potassium bromide solution were added at the same time into an aqueous gelatin solution maintained at 60° C. over 40 minutes according to the double jet method while controlling pH and pAg to obtain an emulsion comprising cubic silver bromide grains with an average grain size of 0.10 μm.

Further, into the emulsion were added at the same time equal moles of aqueous silver nitrate solution and aqueous sodium chloride solution to obtain cubic silver halide grains with an average grain size of 0.45 μm.

The emulsion grains are silver halide grains of the socalled core/shell structure with the core grains of silver bromide coated with the shell of silver chloride (silver chloride content 98 mole %).

Into the emulsion was added the red-sensitive sensitizing dye shown below to effect spectral sensitization, and further 0.3 mole of the cyan coupler shown below emulsified in an aqueous gelatin solution was added per mole of silver halide.

Red-sensitive sensitizing dye:

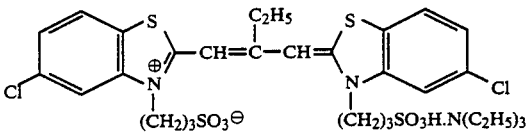

Cyan coupler:

-continued

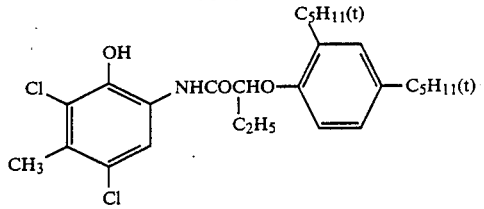

Subsequently, the compound I or II and the gelatin hardener as shown in Table 1 were respectively added, and each mixture was coated and dried to a silver content of 5 mg/dm$^2$ on the resin-coated paper support to prepare direct positive light-sensitive materials (Samples 1 to 7).

One set of samples obtained was left to stand in a refrigerator set at 5° C. (Condition - 1), the other two sets under high temperature and high humidity of 65° C. and relative humidity of 50% (Condition - 2) and 50° C. and relative humidity of 80% (Condition - 3), respectively, for 3 days, and then the three sets were subjected to wedge exposure of 20 CMS with tungsten light by use of a blue color cut filter, followed by development with the following recipe at 38° C. for 2 minutes.

| Color developer composition | |
|---|---|
| Benzyl alcohol | 10 ml |
| Triethanolamine | 10 ml |
| Sodium sulfite | 2 g |
| Potassium bromide | 1.2 g |
| Sodium chloride | 1.0 g |
| Hydroxylamine sulfate | 2 g |
| Sodium carbonate | 30 g |
| 3-Methyl-4-amino-N-ethyl-N-(β-methanesulfonamidoethyl)aniline sulfate | 5.5 g |
| added with water to one liter (adjust to pH 10.2 with sodium hydroxide) | |

However, 10 seconds after initiation of development, the whole surface was exposed uniformly to the light of 1 Lux. Subsequently, bleach-fixing and water washing were performed in conventional manners.

The maximum density $D_{max}$ and the minimum density $D_{min}$ of the cyan positive images obtained by the respective developing processings were measured. The results are shown in Table 1.

TABLE 1

| Sample No. | Compound (amount added*1) | Hardener (amount added*2) | | Condition-1 Dmax | Condition-1 Dmin | Condition-2 Dmax | Condition-2 Dmin | Condition-3 Dmax | Condition-3 Dmin |
|---|---|---|---|---|---|---|---|---|---|
| 1 (Comparative) | — | Compound A*3 | (30) | 2.03 | 0.15 | 2.15 | 0.42 | 2.09 | 0.38 |
| 2 (Comparative) | I-9 (700) | Compound A*3 | (30) | 2.02 | 0.14 | 2.08 | 0.25 | 2.06 | 0.21 |
| 3 (Comparative) | II-19 (100) | Compound A*3 | (30) | 2.00 | 0.12 | 2.05 | 0.21 | 2.05 | 0.19 |
| 4 (Comparative) | — | H-1 | (20) | 2.02 | 0.14 | 2.10 | 0.28 | 2.07 | 0.25 |
| 5 (Comparative) | — | H-6 | (20) | 2.02 | 0.15 | 2.11 | 0.30 | 2.08 | 0.26 |
| 6 (Invention) | I-9 (700) | H-1 | (20) | 2.01 | 0.12 | 2.03 | 0.14 | 2.02 | 0.13 |
| 7 (Invention) | II-19 (100) | H-6 | (20) | 1.98 | 0.11 | 2.01 | 0.13 | 2.00 | 0.13 |

*1mg/mole silver
*2mg/g · gelatin

*3

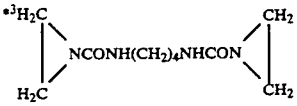

(Comparative hardener)

From the results in Table 1, it is shown that the increase of the minimum density during storage under high temperature and high humidity can be remarkably improved from the present invention (Samples 6 and 7). Also, as compared with the case when the compound (I) or (II) of the present invention and the gelatin hardener are added separately from each other (Samples 2, 3, 4 and 5), it can be understood that the effect can be exhibited synergistically to form a good positive image.

EXAMPLE 2

An acidic aqueous gelatin solution (pH 3) was controlled to 60° C., and under vigorous stirring, into said solution were added at the same time an aqueous silver nitrate solution (pH 3) and an aqueous sodium chloride solution (pH 3) according to the double jet method to obtain an emulsion of cubic silver chloride grains with an average grain size of 0.2 μm.

The pH of the emulsion was adjusted to 5.5 before desalted in conventional manner, and then 6 mg of sodium thiosulfate was added per 1 mol of silver of the emulsion, followed by heating at 50° C. for a certain period of time to effect chemical aging.

The emulsion thus obtained was again adjusted to pH 3 under the same conditions as above, and into the emulsion were added and mixed an aqueous silver nitrate solution and an aqueous sodium chloride solution to further grow the emulsion grains, thereby obtaining an emulsion of cubic silver chloride grains with an average grain size of 0.5 μm. Subsequently, the pH was readjusted to 5.5 before desalting and washing with water, and 2 mg of sodium thiosulfate per mole of silver was added into the emulsion, followed by chemical aging at 50° C., to obtain finally the inner latent image type silver chloride emulsion.

Into the emulsion were added the blue-sensitive sensitizing dye, the yellow coupler, the foggant and the promoter as shown below.

Blue-sensitive sensitizing dye:

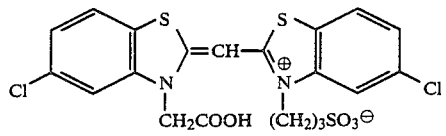

Yellow coupler:

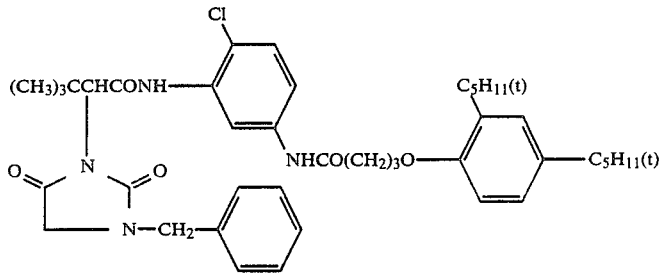

Foggant:

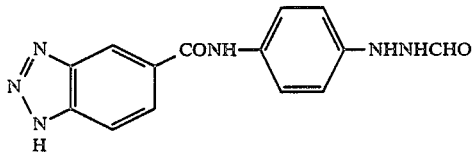

Promoter:

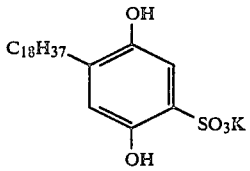

Further, the compound and the gelatin hardener as shown in Table 2 were added and each mixture was coated on the resin-coated paper support to a silver quantity of 4 mg/dm$^2$.

The samples obtained were stored under entirely the same conditions (Condition - 1, 2 and 3) as in Example 1 as described above, subsequently subjected to wedge exposure, developed with a developer having the following recipe at 35° C. for 1 minute, followed further by bleach-fixing, washing with water and drying in conventional manners.

| Color developer composition | |
|---|---|
| Triethanolamine | 10 ml |
| N,N-Diethylhydroxylamine | 4 g |
| Sodium sulfite | 0.1 g |
| Potassium bromide | 0.1 g |
| Sodium chloride | 1 g |
| Sodium carbonate | 30 g |
| 3-Methyl-4-amino-N-ethyl-N- | 5.5 g |

-continued

| Color developer composition |
|---|
| (β-methanesulfonamidoethyl)aniline sulfate |
| Water added to one liter |

The results of yellow positive images obtained are shown in Table 2.

TABLE 2

| Sample No. | Compound (amount added*1) | Hardener (amount added*2) | Condition-1 | | Condition-2 | | Condition-3 | |
|---|---|---|---|---|---|---|---|---|
| | | | Dmax | Dmin | Dmax | Dmin | Dmax | Dmin |
| 8 (Comparative) | — | Compound B*3 (30) | 2.12 | 0.14 | 2.24 | 0.35 | 2.19 | 0.29 |
| 9 (Comparative) | I-15 (100) | Compound B*3 (30) | 2.05 | 0.12 | 2.10 | 0.20 | 2.07 | 0.18 |
| 10 (Invention) | I-15 (100) | H - 1 (20) | 2.04 | 0.11 | 2.07 | 0.14 | 2.05 | 0.13 |
| 11 (Invention) | II-19 (100) | H - 1 (20) | 2.01 | 0.10 | 2.05 | 0.12 | 2.03 | 0.11 |
| 12 (Invention) | II-38 (100) | H - 6 (20) | 2.06 | 0.11 | 2.09 | 0.13 | 2.07 | 0.12 |
| 13 (Invention) | II-47 (100) | H - 6 (20) | 2.05 | 0.11 | 2.08 | 0.13 | 2.06 | 0.11 |

*1mg/mole silver
*2mg/g·gelatin
*3$CH_3SO_3(CH_2)_3SO_3CH_3$ (Comparative hardener)

From the results in Table 2, it is shown that good positive images can be obtained even after storage and lapse of time under severe conditions of high temperature and high humidity by using the compound (I) or (II) of the present invention and a gelatin hardener in combination.

We claim:

1. A direct positive light-sensitive photographic material having at least one silver halide emulsion layer containing inner latent image type silver halide grains not previously fogged, which gives a direct positive image after image exposure by surface development after application of fogging treatment or while applying fogging treatment, wherein said inner latent image type silver halide grains comprise 80 mole % or more of silver chloride, and the silver halide emulsion layer or a hydrophilic colloid layer adjacent thereto contains at least one active halide type or active vinyl type gelatin hardener, and at least one compound represented by the formula (I) or (II) shown below:

Formula (I)

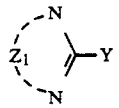

wherein $Z_1$ represents a group of atoms necessary for forming a 5- or 6-membered heterocycle containing at least one of carbon atom and nitrogen atom, which heterocycle may be fused with carbon ring; Y represents an aliphatic group or an aromatic group, Formula (II)

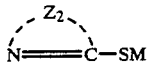

wherein $Z_2$ represents a group of atoms necessary for forming at least one selected from the group consisting of oxadiazole, thiadiazole, triazole, tetrazole, triazine, benzoimidazole, naphthoimidazole, benzoxazole and naphthoxazole ring; M represents hydrogen atom, an alkali metal atom, ammonium group or a precursor group.

2. The direct positive light-sensitive photographic material according to claim 1, wherein the inner latent image type silver halide grains comprise 90 mole % or more of silver chloride.

3. The direct positive light-sensitive photographic material according to claim 1, wherein the inner latent image type silver halide grains have a core/shell structure comprising a core and at least one layer of shell covering over the core.

4. The direct positive light-sensitive photographic material according to claim 3, wherein the shell covers 50% or more of the surface area of the core.

5. The direct positive light-sensitive photographic material according to claim 4, wherein the shell covers the surface area of the core completely.

6. The direct positive light-sensitive photographic material according to claim 1, wherein the active halide type gelatin hardener is a compound containing halogen atoms capable of reacting with gelatin in the molecule.

7. The direct positive light-sensitive photographic material according to claim 6, wherein the active halide type gelatin hardener is at least one selected from the group consisting of

H-1

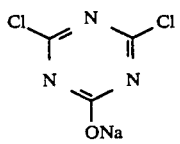

H-2

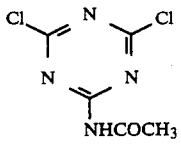

H-3

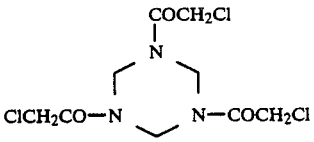

H-4

$ClCH_2COOCH_2CH_2OCOCH_2Cl$

H-5

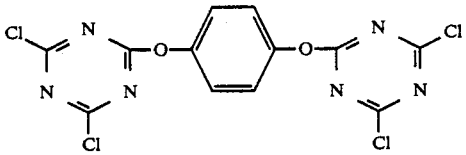

8. The direct positive light-sensitive photographic material according to claim 1, wherein the active vinyl type gelatin hardener is a compound containing a vinyl group capable of reacting with gelatin in the molecule.

9. The direct positive light-sensitive photographic material according to claim 8, wherein the active vinyl type gelatin hardener is at least one selected from the group consisting of $CH_2{=}CHSO_2CH_2CH_2SO_2CH{=}CH_2$ H-6

$CH_2{=}CHSO_2CH_2\underset{\underset{OH}{|}}{C}HCH_2SO_2CH{=}CH_2$ H-7

$CH_2{=}CHSO_2CH_2CH_2CONHCH_2$
$\qquad\qquad\qquad\qquad\qquad\qquad |$
$CH_2{=}CHSO_2CH_2CH_2CONHCH_2$ H-8

$CH_2{=}CHSO_2CH_2OCH_2SO_2CH{=}CH_2$ H-9

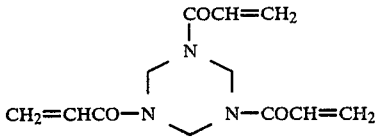
H-10

10. The direct positive light-sensitive photographic material according to claim 1, wherein the amount of the gelatin hardner is within the range of 0.05 to 20% by weight based on the gelatin in a coating solution for forming a gelatin film.

11. The direct positive light-sensitive photographic material according to claim 10, wherein the amount of the gelatin hardner is within the range of 0.1 to 10% by weight based on the gelatin in a coating solution for forming a gelatin film.

12. The direct positive light-sensitive photographic material according to claim 1, wherein the 5- or 6-membered heterocycle is at least one selected from the group consisting of indazole, imidazole, pyrazole, triazole, tetrazole, benzoimidazole, benzotriazole and naphthoimidazole.

13. The direct positive light-sensitive photographic material according to claim 1, wherein the 5- or 6-membered heterocycle have at least one substituents selected from the group consisting of halogen atoms, hydroxyl group, amino group, nitro group, carboxyl group and salts thereof, sulfo group and salts thereof, alkyl group, aryl group, alkoxy group, aryloxy group, alkylthio group, acylamino group, sulfonamide group, carbamoyl group and sulfamoyl group.

14. The direct positive light-sensitive photographic material according to claim 1, wherein the aliphatic group represented by Y is at least one selected from the group consisting of alkyl groups having 1 to 10 carbon atoms, cycloalkyl groups having 3 to 10 carbon atoms and alkenyl groups having 1 to 10 carbon atoms.

15. The direct positive light-sensitive photographic material according to claim 14, wherein the aliphatic group represented by Y is at least one selected from the group consisting of alkyl groups having 1 to 8 carbon atoms cycloalkyl groups having 3 to 10 carbon atoms and alkenyl groups having 3 to 8 carbon atoms.

16. The direct positive light-sensitive photographic material according to claim 1, wherein the aromatic group represented by Y is at least one selected from the group consisting of phenyl group and naphthyl group.

17. The direct positive light-sensitive photographic material according to claim 1, wherein the compound represented by the formula (I) is used and is a compound represented by the following formula (I-A):

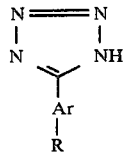

wherein Ar represents an aryl group, and R represents a substituent possessed by the Ar group.

18. The direct positive light-sensitive photographic material according to claim 17, wherein R is at least one selected from the group consisting of hydrogen atom, cyano group, nitro group, alkyl groups having 1 to 10 carbon atoms, alkenyl groups having 2 to 10 carbon atoms, cycloalkyl groups having 3 to 10 carbon atoms, alkoxy groups having 1 to 10 carbon atoms, aryloxy groups, amino groups, hydroxyl group, carbamoyl group, sulfamoyl group, carbonamide group, ureido groups, acyl group, acyloxy group, carboxyl group and salts thereof, sulfo group and salts thereof, alkoxycarbonyl group, aryloxycarbonyl group and aralkyl group.

19. The direct positive light-sensitive photographic material according to claim 18, wherein the alkyl group represented by R is substituted with at least one selected from the group consisting of halogen atoms, hydroxyl group, carboxyl group, phenyl group, alkylthio group, arylthio group, acyl group and alkoxycarbonyl group.

20. The direct positive light-sensitive photographic material according to claim 1, wherein the oxadiazole, thiadiazole, triazole, tetrazole, triazine, benzoimidazole, naphthoimidazole, benzoxazole and naphthoxazole ring have a substituent selected from the group consisting of alkyl groups which may be substituted, alkenyl groups, cycloalkyl groups, aryl groups which may be substituted, alkoxy groups, alkylthio groups, amino groups, carbamoyl group, sulfamoyl groups, carbonamide groups, sulfonamide groups, ureido groups, acyl groups, acyloxy groups, carboxyl group and salts thereof, sulfo group and salts thereof, alkoxycarbonyl groups, aryloxycarbonyl groups, cyano group, nitro group and hydroxyl group.

21. The direct positive light-sensitive photographic material according to claim 1, wherein the compound represented by the formula (II) used and is is a compound represented by the formula (II-A):

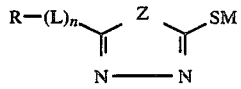

In the formula, Z represents at least one selected from the group consisting of oxygen atom, sulfur atom and

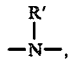

where R′ represents at least one selected from the group consisting of hydrogen atom, an alkyl group, an alkenyl group, an aryl group and an acyl group; L represents a divalent linking group; R represents at least one selected from the group consisting of an alkyl group, an alkenyl group and an aryl group; M represents at least one selected from the group consisting of hydrogen atom, an alkali metal atom, ammonium group and a precursor; and n represents 0 or 1.

22. The direct positive light-sensitive photographic material according to claim 21, wherein the precursor is at least one selected from the group consisting of acetyl group, cyanoethyl group and methanesulfonylethyl group.

23. The direct positive light-sensitive photographic material according to claim 21, wherein the divalent linking group is at least one selected from the group consisting of

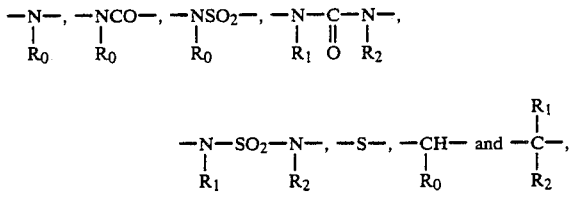

wherein each of $R_0$, $R_1$ and $R_2$ represents at least one selected from the group consisting of hydrogen atom, an alkyl group and an aralkyl group; and combinations of these.

24. The direct positive light-sensitive photographic material according to claim 1 wherein the compound of formula (I) is used.

25. The direct positive light-sensitive photographic material according to claim 1 wherein the compound of formula (II) is used.

26. A direct positive light-sensitive photographic material having at least one silver halide emulsion layer containing inner latent image type silver halide grains not previously fogged, which gives a direct positive image after image exposure by surface development after application of fogging treatment or while applying fogging treatment, wherein said inner latent image type silver halide grains comprise substantially silver chloride, and the silver halide emulsion layer or a hydrophilic colloid layer adjacent thereto contains at least one active halide type or active vinyl type gelatin hardener, and at least one compound represented by the formula (I) or (II) shown below:

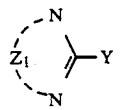

Formula (I)

wherein $Z_1$ represents a group of atoms necessary for forming a 5- or 6-membered heterocycle containing at least one of carbon atom and nitrogen atom, which heterocycle may be fused with carbon ring; Y represents an aliphatic group or an aromatic group,

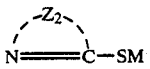

Formula (II)

wherein $Z_2$ represents a group of atoms necessary for forming at least one selected from the group consisting of oxadiazole, thiadiazole, triazole, tetrazole, triazine, benzoimidazole, naphthoimidazole, benzoxazole and naphthoxazole ring; M r epresents hydrogen atom, an alkali metal atom, ammonium group or a precursor group; and wherein the active vinyl type gelatin hardener is a compound containing a vinyl group capable of reacting with gelatin in the molecule and is at least one selected from the group consisting of

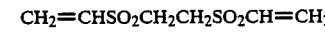

H-6

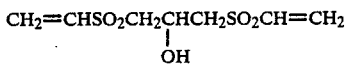

H-7

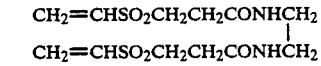

H-8

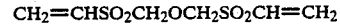

H-9

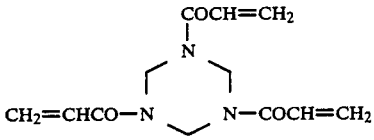

H-10

* * * * *